US009119010B2

(12) United States Patent
Ruppersberg et al.

(10) Patent No.: US 9,119,010 B2
(45) Date of Patent: Aug. 25, 2015

(54) IMPLANTABLE SOUND TRANSMISSION DEVICE FOR MAGNETIC HEARING AID, AND CORRESPONDING SYSTEMS, DEVICES AND COMPONENTS

(71) Applicant: Sophono, Inc., Boulder, CO (US)

(72) Inventors: Peter Ruppersberg, Blonay (CH); Markus C Haller, Nyon (CH); Todd C Wyant, Louisville, CO (US); Nicholas F Pergola, Arvada, CO (US)

(73) Assignee: Sophono, Inc., Boulder, CO (US)

( * ) Notice: Subject to any disclaimer, the term of this patent is extended or adjusted under 35 U.S.C. 154(b) by 0 days.

(21) Appl. No.: 14/288,142

(22) Filed: May 27, 2014

(65) Prior Publication Data

US 2014/0275735 A1 Sep. 18, 2014

Related U.S. Application Data

(63) Continuation-in-part of application No. 13/550,581, filed on Jul. 16, 2012, and a continuation-in-part of application No. 13/650,026, filed on Oct. 11, 2012, and a continuation-in-part of application No.

(Continued)

(51) Int. Cl.
*H04R 25/00* (2006.01)
*H04R 3/00* (2006.01)

(52) U.S. Cl.
CPC ..... *H04R 25/606* (2013.01); *H04R 3/002* (2013.01); *H04R 25/608* (2013.01); *H04R 2460/13* (2013.01)

(58) Field of Classification Search
None
See application file for complete search history.

(56) References Cited

U.S. PATENT DOCUMENTS

| | | | | |
|---|---|---|---|---|
| 4,352,960 | A | 10/1982 | Dormer et al. | |
| 4,612,915 | A | 9/1986 | Hough et al. | |
| 4,726,378 | A | 2/1988 | Kaplan | |
| 4,736,747 | A | 4/1988 | Drake | |
| RE32,947 | E | 6/1989 | Dormer | |
| 4,918,745 | A | 4/1990 | Hutchison | |
| 5,558,618 | A | 9/1996 | Maniglia | |
| 5,859,916 | A * | 1/1999 | Ball et al. | 381/326 |
| 5,906,635 | A | 5/1999 | Maniglia | |
| 5,913,815 | A * | 6/1999 | Ball et al. | 600/25 |
| 5,941,814 | A * | 8/1999 | Lehner et al. | 600/25 |
| 6,246,911 | B1 | 6/2001 | Seligman | |

(Continued)

OTHER PUBLICATIONS

"A Miniature Bone Vibrator for Hearing Aids and Similar Applications," BHM-Tech Produktionsgesellschaft m.b.H, Austria, 2004, Technical Data VKH3391W.

(Continued)

*Primary Examiner* — Curtis Kuntz
*Assistant Examiner* — Qin Zhu
(74) *Attorney, Agent, or Firm* — Woods Patent Law

(57) ABSTRACT

Various embodiments of systems, devices, components, and methods are disclosed for a magnetic hearing aid system comprising an implantable sound transmission device configured for implantation in a patient's skull. The sound transmission device is configured to receive acoustic signals generated by an EM transducer in a magnetic hearing aid that are transmitted through the patient's skin, and to transmit the received acoustic signals to the patient's cochlea via one or more sound-transmitting metal members. According to some embodiments, the sound transmission device is curved to permit optimal placement of the hearing aid and corresponding magnetic implant behind a patient's ear.

54 Claims, 12 Drawing Sheets

Related U.S. Application Data

13/650,057, filed on Oct. 11, 2012, and a continuation-in-part of application No. 13/650,080, filed on Oct. 11, 2012, and a continuation-in-part of application No. 13/649,934, filed on Oct. 11, 2012, and a continuation-in-part of application No. 13/256,571, filed on Dec. 9, 2011, and a continuation-in-part of application No. 13/804,420, filed on Mar. 14, 2013, and a continuation-in-part of application No. 13/793,218, filed on Mar. 11, 2013.

(60) Provisional application No. 61/970,336, filed on Mar. 25, 2014.

(56) References Cited

U.S. PATENT DOCUMENTS

| | | | | |
|---|---|---|---|---|
| 6,358,281 | B1 | 3/2002 | Berrang et al. | |
| 6,398,717 | B1 * | 6/2002 | Leysieffer et al. | 600/25 |
| 6,517,476 | B1 * | 2/2003 | Bedoya et al. | 600/25 |
| 6,537,200 | B2 | 3/2003 | Leysieffer et al. | |
| 6,565,503 | B2 | 5/2003 | Leysieffer et al. | |
| 6,648,914 | B2 | 11/2003 | Berrang et al. | |
| 6,755,778 | B2 * | 6/2004 | Kroll et al. | 600/25 |
| 7,021,676 | B2 | 4/2006 | Westerkull | |
| 7,065,223 | B2 | 6/2006 | Westerkull | |
| 7,186,211 | B2 | 3/2007 | Schneider et al. | |
| 7,386,143 | B2 | 6/2008 | Easter et al. | |
| 7,599,508 | B1 | 10/2009 | Lynch et al. | |
| 7,856,986 | B2 | 12/2010 | Darley | |
| 8,107,661 | B1 | 1/2012 | Lynch et al. | |
| 8,170,253 | B1 | 5/2012 | Lynch et al. | |
| 8,255,058 | B2 | 8/2012 | Gibson et al. | |
| 8,270,647 | B2 | 9/2012 | Crawford et al. | |
| 8,315,705 | B2 | 11/2012 | Keuninckx | |
| 8,369,959 | B2 | 2/2013 | Meskens | |
| 8,406,888 | B2 | 3/2013 | Parker et al. | |
| 8,433,081 | B2 | 4/2013 | Parker | |
| 8,452,412 | B2 | 5/2013 | Ibrahim | |
| 8,509,461 | B2 | 8/2013 | Parker | |
| 8,515,112 | B2 | 8/2013 | Crawford et al. | |
| 8,526,641 | B2 | 9/2013 | Parker et al. | |
| 8,532,322 | B2 | 9/2013 | Parker | |
| 8,538,545 | B2 | 9/2013 | Meskens | |
| 8,774,930 | B2 | 7/2014 | Ball | |
| 8,787,608 | B2 | 7/2014 | Van Himbeeck et al. | |
| 8,790,237 | B2 * | 7/2014 | Vermeiren | 600/25 |
| 8,811,643 | B2 | 8/2014 | Crawford et al. | |
| 8,891,795 | B2 | 11/2014 | Andersson | |
| 8,897,475 | B2 | 11/2014 | Ball et al. | |
| 8,897,883 | B2 | 11/2014 | Griffith | |
| 8,923,968 | B2 | 12/2014 | Meskens | |
| 8,934,984 | B2 | 1/2015 | Meskens et al. | |
| 2001/0049466 | A1 * | 12/2001 | Leysieffer et al. | 600/25 |
| 2004/0133065 | A1 * | 7/2004 | Easter et al. | 600/25 |
| 2004/0147804 | A1 * | 7/2004 | Schneider et al. | 600/25 |
| 2005/0249366 | A1 * | 11/2005 | Westerkull | 381/151 |
| 2006/0015155 | A1 * | 1/2006 | Charvin et al. | 607/57 |
| 2006/0281963 | A1 * | 12/2006 | Easter et al. | 600/25 |
| 2007/0053536 | A1 | 3/2007 | Westerkull | |
| 2007/0274551 | A1 | 11/2007 | Tsai et al. | |
| 2008/0167516 | A1 * | 7/2008 | Jaeger et al. | 600/25 |
| 2008/0249351 | A1 * | 10/2008 | Schneider et al. | 600/25 |
| 2009/0023976 | A1 * | 1/2009 | Cho et al. | 600/25 |
| 2009/0240099 | A1 * | 9/2009 | Conn | 600/25 |
| 2009/0248155 | A1 | 10/2009 | Parker | |
| 2009/0281367 | A1 * | 11/2009 | Cho et al. | 600/25 |
| 2009/0299437 | A1 | 12/2009 | Zimmerling | |
| 2009/0306458 | A1 * | 12/2009 | Parker et al. | 600/25 |
| 2009/0306744 | A1 * | 12/2009 | Parker et al. | 607/57 |
| 2010/0145135 | A1 * | 6/2010 | Ball et al. | 600/25 |
| 2011/0022120 | A1 | 1/2011 | Ball et al. | |
| 2011/0216927 | A1 * | 9/2011 | Ball | 381/313 |
| 2012/0029267 | A1 * | 2/2012 | Ball | 600/25 |
| 2012/0041515 | A1 | 2/2012 | Meskens et al. | |
| 2012/0088957 | A1 | 4/2012 | Adamson et al. | |
| 2012/0238799 | A1 | 9/2012 | Ball et al. | |
| 2012/0239113 | A1 * | 9/2012 | Vermeiren | 607/57 |
| 2012/0253104 | A1 * | 10/2012 | Andersson et al. | 600/25 |
| 2012/0296155 | A1 | 11/2012 | Ball | |
| 2012/0302823 | A1 | 11/2012 | Andersson et al. | |
| 2013/0018218 | A1 * | 1/2013 | Haller et al. | 600/25 |
| 2013/0035540 | A1 * | 2/2013 | Ball | 600/25 |
| 2013/0046131 | A1 | 2/2013 | Ball et al. | |
| 2013/0096367 | A1 * | 4/2013 | Easter | 600/25 |
| 2013/0261377 | A1 | 10/2013 | Adamson et al. | |
| 2013/0281764 | A1 | 10/2013 | Bjorn et al. | |
| 2014/0094646 | A1 * | 4/2014 | Leigh et al. | 600/25 |
| 2014/0107526 | A1 * | 4/2014 | Thibaut et al. | 600/559 |
| 2014/0121447 | A1 | 5/2014 | Kasic et al. | |
| 2014/0121449 | A1 | 5/2014 | Kasic et al. | |
| 2014/0121450 | A1 | 5/2014 | Kasic et al. | |
| 2014/0121451 | A1 | 5/2014 | Kasic et al. | |
| 2014/0121452 | A1 | 5/2014 | Kasic et al. | |
| 2014/0163309 | A1 * | 6/2014 | Bernhard et al. | 600/25 |
| 2014/0193011 | A1 | 7/2014 | Parker | |
| 2014/0270293 | A1 | 9/2014 | Ruppersberg et al. | |
| 2014/0275735 | A1 | 9/2014 | Ruppersberg et al. | |
| 2014/0275736 | A1 | 9/2014 | Ruppersberg et al. | |
| 2014/0336447 | A1 | 11/2014 | Bjorn et al. | |
| 2015/0016649 | A1 | 1/2015 | Van Himbeeck et al. | |

OTHER PUBLICATIONS

"Microphone 8010T", Data Sheet, RoHS, Sonion, Dec. 20, 2007.

"Inspiria Extreme Digital DSP System," Preliminary Data Sheet, Sound Design Technologies, Mar. 2009.

Physician Manual, Alpha I(S) and Alpha I (M) Bone Conduction Hearing Systems, REV A S0300-00.

* cited by examiner

AUDIANT
(PRIOR ART)

BAHA
(PRIOR ART)

ALPHA 1
(PRIOR ART)

IMPLANTABLE SOUND TRANSMISSION DEVICE FOR MAGNETIC HEARING AID, AND CORRESPONDING SYSTEMS, DEVICES AND COMPONENTS

RELATED APPLICATIONS

This application is a continuation-in-part of, and claims priority and other benefits from each of the following U.S. patent applications: (a) U.S. patent application Ser. No. 13/550,581 entitled "Systems, Devices, Components and Methods for Bone Conduction Hearing Aids" to Pergola et al. filed Jul. 16, 2012 (hereafter "the '581 patent application"); (b) U.S. patent application Ser. No. 13/650,026 entitled "Magnetic Abutment Systems, Devices, Components and Methods for Bone Conduction Hearing Aids" to Kasic et al. filed on Oct. 11, 2012 (hereafter "the '650 patent application"); (c) U.S. patent application Ser. No. 13/650,057 entitled "Magnetic Spacer Systems, Devices, Components and Methods for Bone Conduction Hearing Aids" to Kasic et al. filed on Oct. 11, 2012 (hereafter "the '057 patent application"); (d) U.S. patent application Ser. No. 13/650,080 entitled "Abutment Attachment Systems, Mechanisms, Devices, Components and Methods for Bone Conduction Hearing Aids" to Kasic et al. filed on Oct. 11, 2012 (hereafter "the '080 patent application"), (e) U.S. patent application Ser. No. 13/649,934 entitled "Adjustable Magnetic Systems, Devices, Components and Methods for Bone Conduction Hearing Aids" to Kasic et al. filed on Oct. 11, 2012 (hereafter "the '934 patent application"); (f) U.S. patent application Ser. No. 13/256,571 entitled "Aid for Shimming Magnetic Discs" to Siegert filed on Dec. 9, 2011 (hereafter "the '571 patent application"); (g) U.S. patent application Ser. No. 13/804,420 entitled "Adhesive Bone Conduction Hearing Device" to Kasic et al. filed on Mar. 13, 2013 (hereafter "the '420 patent application"), and (h) U.S. patent application Ser. No. 13/793,218 entitled "Cover for Magnetic Implant in a Bone Conduction Hearing Aid System, and Corresponding Devices, Components and Methods" to Kasic et al. filed on Mar. 11, 2013 (hereafter "the '218 patent application"). This application also claims priority and other benefits from U.S. Provisional Patent Application Ser. No. 61/970,336 entitled "Systems, Devices, Components and Methods for Magnetic Bone Conduction Hearing Aids" to Ruppersberg et al. filed on Mar. 25, 2014. Each of the foregoing patent applications is hereby incorporated by reference herein, each in its respective entirety.

This application further incorporates by reference herein, each in its respective entirety, the following U.S. patent applications filed on even date herewith: (a) U.S. patent application Ser. No. 14/288,181 entitled "Sound Acquisition and Analysis Systems, Devices and Components for Magnetic Hearing Aids" to Ruppersberg et al. (hereafter "the '125 patent application"), and (b) U.S. patent application Ser. No. 14/288,100 entitled "Systems, Devices, Components and Methods for Providing Acoustic Isolation Between Microphones and Transducers in Magnetic Hearing Aids" to Ruppersberg et al. (hereafter "the '120 patent application").

FIELD OF THE INVENTION

Various embodiments of the invention described herein relate to the field of systems, devices, components, and methods for bone conduction and other types of hearing aid devices.

BACKGROUND

A magnetic bone conduction hearing aid is held in position on a patient's head by means of magnetic attraction that occurs between magnetic members included in the hearing aid and in a magnetic implant that has been implanted beneath the patient's skin and affixed to the patient's skull. Acoustic signals originating from an electromagnetic transducer located in the external hearing aid are transmitted through the patient's skin to bone in the vicinity of the underlying magnetic implant, and thence through the bone to the patient's cochlea. In some patients, the resulting acoustic signals which they perceive are not strong enough or of sufficient fidelity to produce sufficiently high qualities or levels of hearing.

What is needed is a magnetic hearing aid system that somehow provides improved sound transmission and hearing to a patient.

SUMMARY

In one embodiment, there is provided a magnetic hearing aid system, comprising an electromagnetic ("EM") transducer disposed in a housing, a magnetic spacer operably coupled to the EM transducer and comprising at least a first magnetic member, the EM transducer and magnetic spacer forming external portions of the magnetic hearing aid system, a magnetic implant configured for placement beneath a patient's skin and adjacent to or in a patient's skull, the magnetic implant comprising at least a second magnetic member, the magnetic spacer and magnetic implant together being configured such that the first and second magnetic members are capable of holding the EM transducer and magnetic spacer in position on the patient's head over at least portions of the magnetic implant through the patient's skin, and an implantable biocompatible sound transmission device configured for implantation in a patient's skull and comprising proximal and distal ends, the proximal end being configured for placement near or at an interface disposed between the patient's skin and skull bone located therebeneath, the distal end being configured for placement near or at a cochlea of the patient, wherein the proximal end of the sound transmission device is configured to receive acoustic signals generated by the EM transducer and transmitted through the patient's skin, the sound transmission device is further configured to transmit the received acoustic signals from the proximal end to the distal end thereof, and the sound transmission device comprises at least a first sound-transmitting metal member.

In another embodiment, there is provided an implantable biocompatible sound transmission device for use in a magnetic hearing aid system, the system comprising an electromagnetic ("EM") transducer disposed in a housing, a magnetic spacer operably coupled to the EM transducer and comprising at least a first magnetic member, the EM transducer and magnetic spacer forming external portions of the magnetic hearing aid system, and a magnetic implant configured for placement beneath a patient's skin and adjacent to or in a patient's skull, the magnetic implant comprising at least a second magnetic member, the magnetic spacer and magnetic implant together being configured such that the first and second magnetic members are capable of holding the EM transducer and magnetic spacer in position on the patient's head over at least portions of the magnetic implant through the patient's skin, the sound transmission device comprising proximal and distal ends, the proximal end being configured for placement near or at an interface disposed between the patient's skin and skull bone located therebeneath, the distal end being configured for placement near or at a cochlea of the patient, the proximal end of the sound transmission device being configured to receive acoustic signals generated by the EM transducer and transmitted through the patient's skin, the sound transmission device further being configured to transmit the received acoustic signals from the proximal end to the distal end thereof, the sound transmission device comprising at least a first sound-transmitting metal member.

In still another embodiment, there is provided a method of implanting an implantable biocompatible sound transmission device for use in a magnetic hearing aid system, the system comprising an electromagnetic ("EM") transducer disposed in a housing, a magnetic spacer operably coupled to the EM transducer and comprising at least a first magnetic member, the EM transducer and magnetic spacer forming external portions of the magnetic hearing aid system, and a magnetic implant configured for placement beneath a patient's skin and adjacent to or in a patient's skull, the magnetic implant comprising at least a second magnetic member, the magnetic spacer and magnetic implant together being configured such that the first and second magnetic members are capable of holding the EM transducer and magnetic spacer in position on the patient's head over at least portions of the magnetic implant through the patient's skin, the sound transmission device comprising proximal and distal ends, the proximal end being configured for placement near or at an interface disposed between the patient's skin and skull bone located therebeneath, the distal end being configured for placement near or at a cochlea of the patient, the proximal end of the sound transmission device being configured to receive acoustic signals generated by the EM transducer and transmitted through the patient's skin, the sound transmission device further being configured to transmit the received acoustic signals from the proximal end to the distal end thereof, the sound transmission device comprising at least a first sound-transmitting metal member, the method comprising forming a passageway in the patient's skull between a proximal location behind the patient's ear and a distal location near the patient's cochlea, and implanting the sound transmission device in the passageway with the distal end thereof acoustically and operably connected to the patient's cochlea.

Further embodiments are disclosed herein or will become apparent to those skilled in the art after having read and understood the specification and drawings hereof.

BRIEF DESCRIPTION OF THE DRAWINGS

Different aspects of the various embodiments will become apparent from the following specification, drawings and claims in which:

FIG. 2(*b*) shows one embodiment of a prior art wiring diagram for a SOPHONO ALPHA 1 hearing aid manufactured using an SA3286 DSP;

FIG. 3(*b*) shows one embodiment of a prior art SOPHONO® ALPHA 1® hearing aid 10;

FIG. 3(*c*) shows another embodiment of a prior art SOPHONO® ALPHA® hearing aid 10;

The drawings are not necessarily to scale. Like numbers refer to like parts or steps throughout the drawings.

DETAILED DESCRIPTIONS OF SOME EMBODIMENTS

Described herein are various embodiments of systems, devices, components and methods for bone conduction and/or bone-anchored hearing aids.

A bone-anchored hearing device (or "BAHD") is an auditory prosthetic device based on bone conduction having a portion or portions thereof which are surgically implanted. A BAHD uses the bones of the skull as pathways for sound to travel to a patient's inner ear. For people with conductive hearing loss, a BAHD bypasses the external auditory canal and middle ear, and stimulates the still-functioning cochlea via an implanted metal post. For patients with unilateral hearing loss, a BAHD uses the skull to conduct the sound from the deaf side to the side with the functioning cochlea. In most BAHA systems, a titanium post or plate is surgically embedded into the skull with a small abutment extending through and exposed outside the patient's skin. A BAHD sound processor attaches to the abutment and transmits sound vibrations through the external abutment to the implant. The implant vibrates the skull and inner ear, which stimulates the nerve fibers of the inner ear, allowing hearing. A BAHD device can also be connected to an FM system or iPod by means of attaching a miniaturized FM receiver or Bluetooth connection thereto.

BAHD devices manufactured by COCHLEAR™ of Sydney, Australia, and OTICON™ of Smoerum, Denmark. SOPHONO™ of Boulder, Colo. manufactures an Alpha 1 magnetic hearing aid device, which attaches by magnetic means behind a patient's ear to the patient's skull by coupling to a magnetic or magnetized bone plate (or "magnetic implant") implanted in the patient's skull beneath the skin.

Surgical procedures for implanting such posts or plates are relatively straightforward, and are well known to those skilled in the art. See, for example, "Alpha I (S) & Alpha I (M) Physician Manual—REV A S0300-00" published by Sophono, Inc. of Boulder, Colo., the entirety of which is hereby incorporated by reference herein.

Figure 1C:
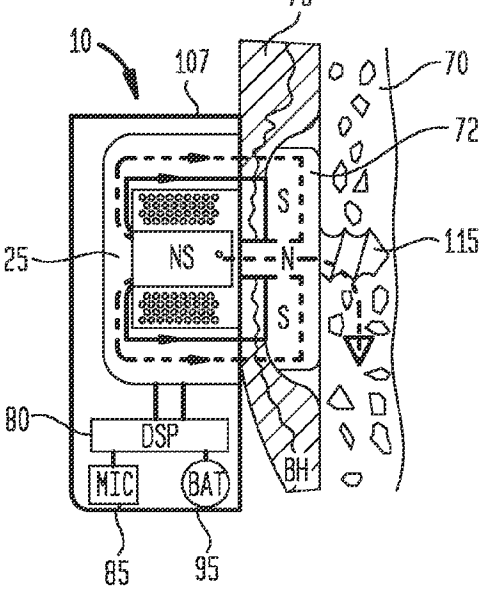
FIGS. 1(*a*), 1(*b*) and 1(*c*) show side cross-sectional schematic views of selected embodiments of prior art SOPHONO® ALPHA 1™, BAHA® and AUDIANT® bone conduction hearing aids, respectively.
Figure 1B:
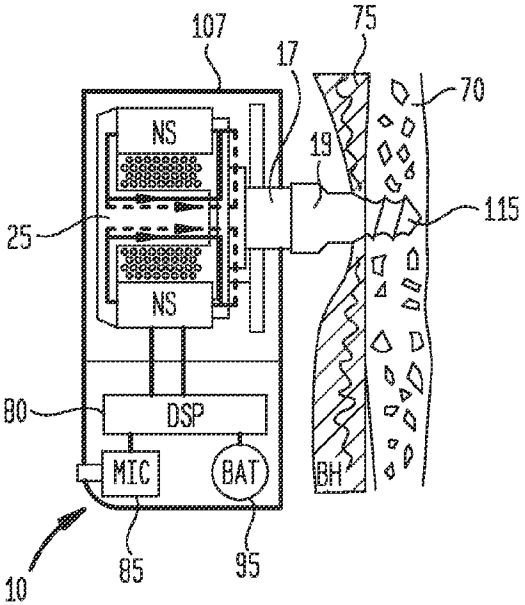
Figure 1A:
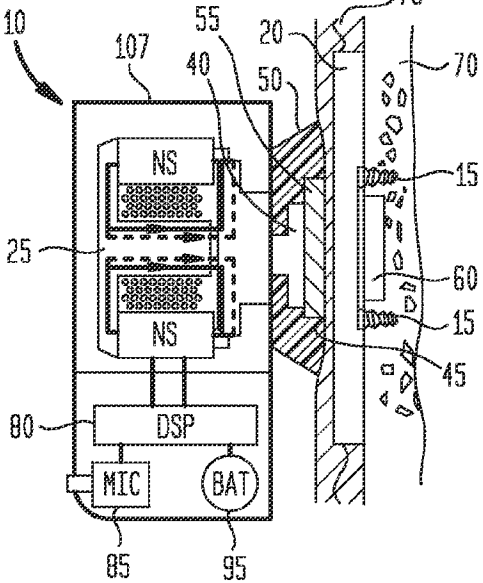

FIGS. 1(*a*), 1(*b*) and 1(*c*) show side cross-sectional schematic views of selected embodiments of prior art SOPHONO ALPHA 1, BAHA and AUDIANT bone conduction hearing aids, respectively. Note that FIGS. 1(*a*), 1(*b*) and 1(*c*) are not necessarily to scale.

In FIG. 1(*a*), magnetic hearing aid device 10 comprises housing 107, electromagnetic/bone conduction ("EM") transducer 25 with corresponding magnets and coils, digital signal processor ("DSP") 80, battery 95, magnetic spacer 50, magnetic implant or magnetic implant bone plate 20. As shown in FIGS. 1(*a*) and 2(*a*), and according to one embodiment, magnetic implant 20 comprises a frame 21 (see FIG. 3(*a*)) formed of a biocompatible metal such as medical grade titanium that is configured to have disposed therein or have attached thereto implantable magnets or magnetic members 60.

Figure 3C:
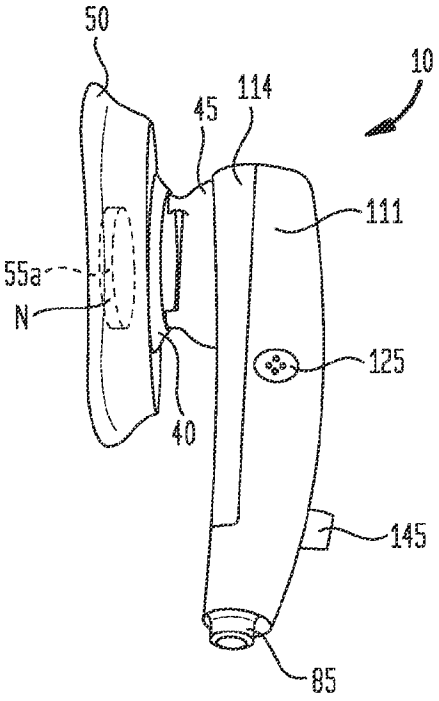
FIG. 3(c) (PRIOR ART)
FIG. 3(*a*) shows one embodiment of prior art magnetic implant 20 according to FIG. 1(*a*)
Figure 3B:
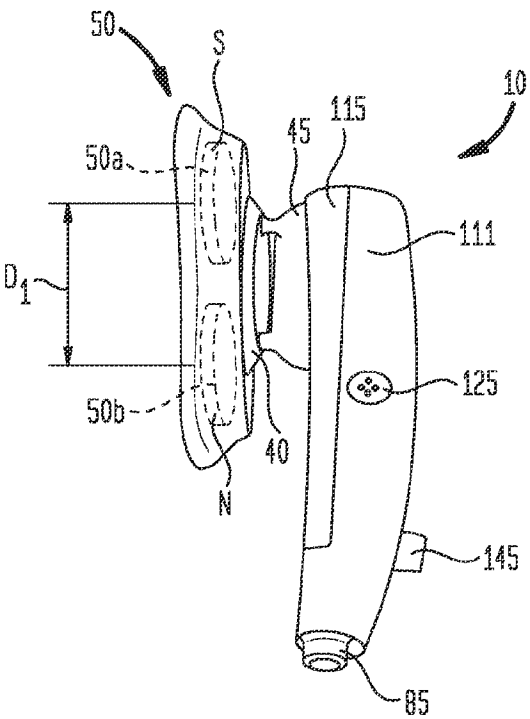
FIG. 3(b) (PRIOR ART)
Figure 3A:
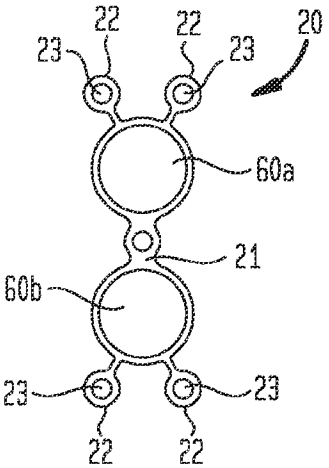
FIG. 3(a) (PRIOR ART)

Bone screws 15 secure or affix magnetic implant 20 to skull 70, and are disposed through screw holes 23 positioned at the outward ends of arms 22 of magnetic implant frame 21 (see FIG. 3(*a*)). Magnetic members 60*a* and 60*b* are configured to couple magnetically to one or more corresponding external magnetic members or magnets 55 mounted onto or into, or otherwise forming a portion of, magnetic spacer 50, which in turn is operably coupled to EM transducer 25 and metal disc 40. DSP 80 is configured to drive EM transducer 25, metal disk 40 and magnetic spacer 50 in accordance with external audio signals picked up by microphone 85. DSP 80 and EM transducer 25 are powered by battery 95, which according to one embodiment may be a zinc-air battery, or may be any other suitable type of primary or secondary (i.e., rechargeable) electrochemical cell such as an alkaline or lithium battery.

As further shown in FIG. 1(*a*), magnetic implant 20 is attached to patient's skull 70, and is separated from magnetic spacer 50 by patient's skin 75. Hearing aid device 10 of FIG. 1(*a*) is thereby operably coupled magnetically and mechanically to plate 20 implanted in patient's skull 70, which permits the transmission of audio signals originating in DSP 80 and EM transducer 25 to the patient's inner ear via skull 70.

FIG. 1(*b*) shows another embodiment of hearing aid 10, which is a BAHA® device comprising housing 107, EM transducer 25 with corresponding magnets and coils, DSP 80, battery 95, external post 17, internal bone anchor 115, and abutment member 19. In one embodiment, and as shown in FIG. 1(*b*), internal bone anchor 115 includes a bone screw formed of a biocompatible metal such as titanium that is configured to have disposed thereon or have attached thereto abutment member 19, which in turn may be configured to mate mechanically or magnetically with external post 17, which in turn is operably coupled to EM transducer 25. DSP 80 is configured to drive EM transducer 25 and external post 17 in accordance with external audio signals picked up by microphone 85. DSP 80 and EM transducer 25 are powered by battery 95, which according to one embodiment is a zinc-air battery (or any other suitable battery or electrochemical cell as described above). As shown in FIG. 1(*b*), implantable bone anchor 115 is attached to patient's skull 70, and is also attached to external post 17 through abutment member 19, either mechanically or by magnetic means.

Hearing aid device 10 of FIG. 1(*b*) is thus coupled magnetically and/or mechanically to bone anchor 115 implanted in patient's skull 70, thereby permitting the transmission of audio signals originating in DSP 80 and EM transducer 25 to the patient's inner ear via skull 70.

FIG. 1(*c*) shows another embodiment of hearing aid 10, which is an AUDIANT®-type device, where an implantable magnetic member 72 is attached by means of bone anchor 115 to patient's skull 70. Internal bone anchor 115 includes a bone screw formed of a biocompatible metal such as titanium, and has disposed thereon or attached thereto implantable magnetic member 72, which couples magnetically through patient's skin 75 to EM transducer 25. DSP 80 is configured to drive EM transducer 25 in accordance with external audio signals picked up by microphone 85.

Hearing aid device 10 of FIG. 1(*c*) is thus coupled magnetically to bone anchor 115 implanted in patient's skull 70, thereby permitting the transmission of audio signals originating in DSP 80 and EM transducer 25 to the patient's inner ear via skull 70.

Figure 2A:
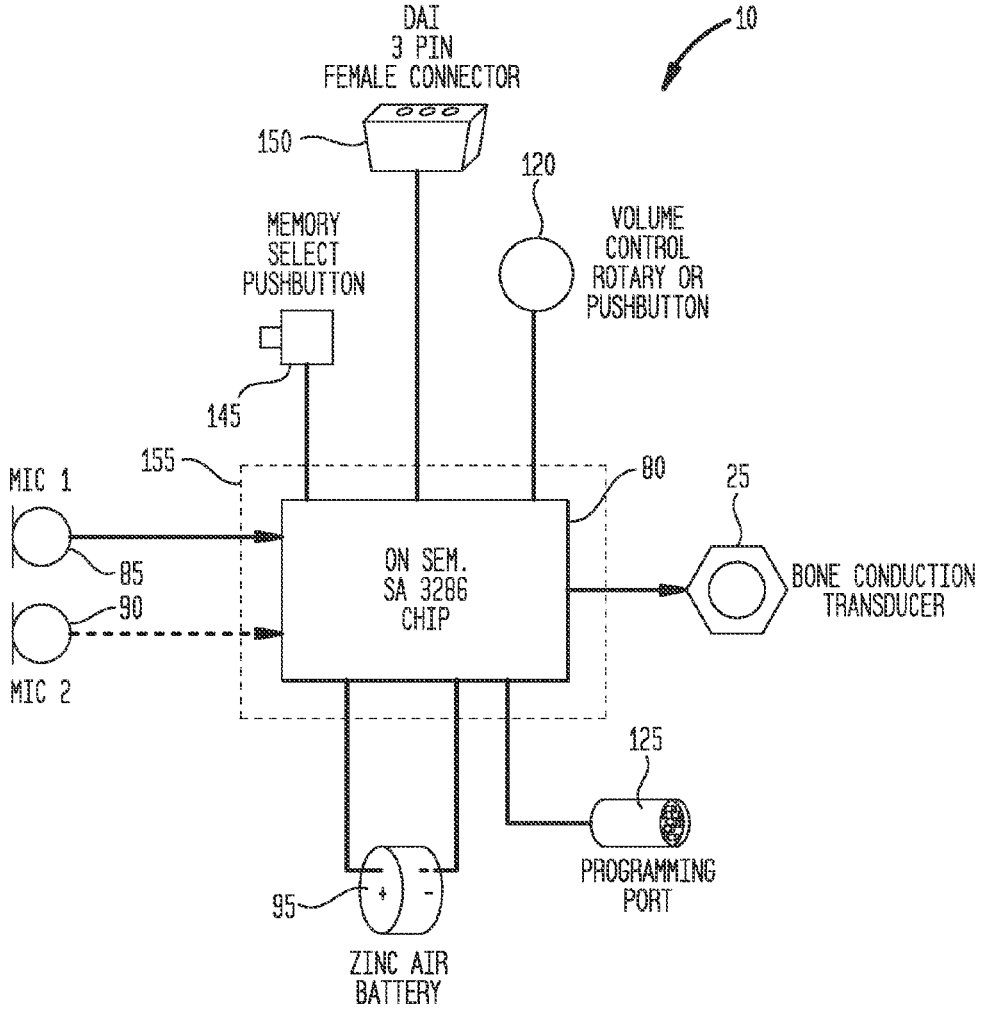
FIG. 2(a) (PRIOR ART)
FIG. 2(*a*) shows one embodiment of a prior art functional electronic and electrical block diagram of hearing aid 10 shown in FIGS. 1(*a*) and 3(*b*)
Figure 2B:
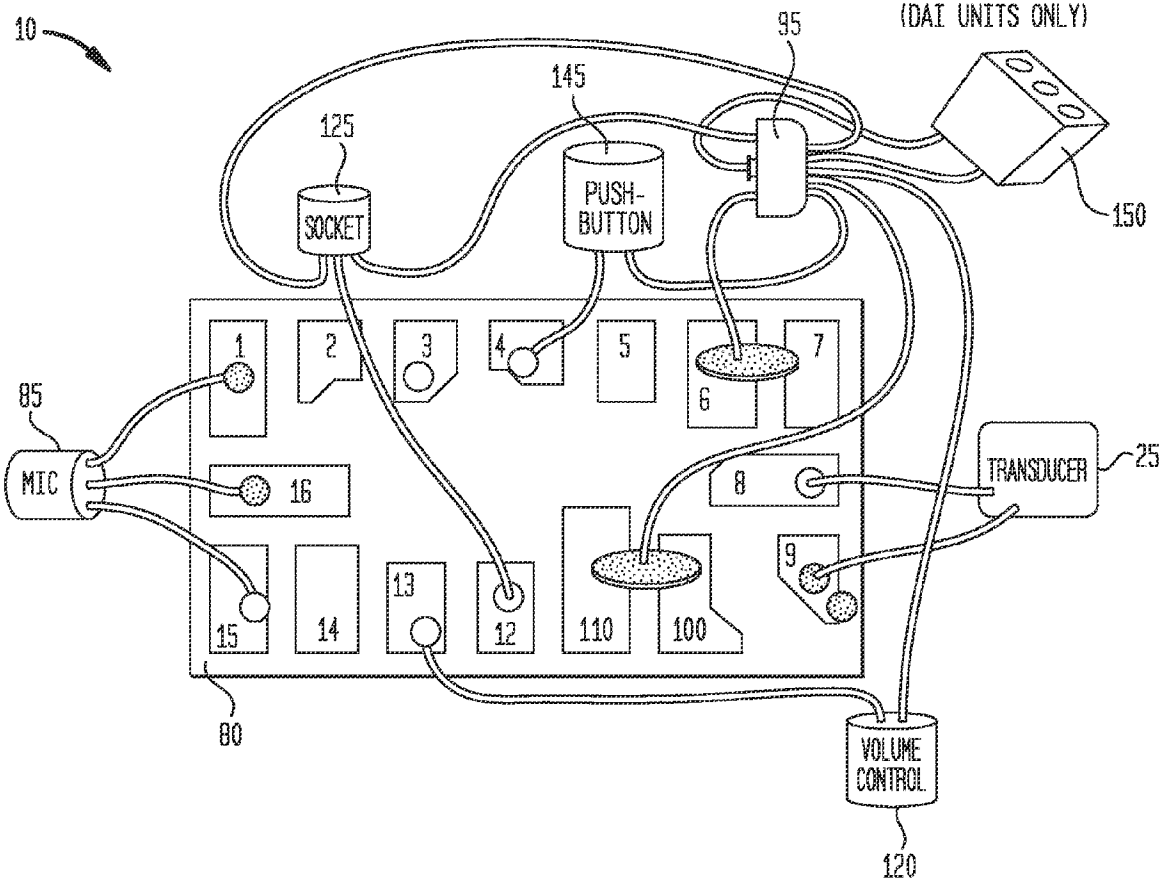
FIG. 2(b) (PRIOR ART)

FIG. 2(*a*) shows one embodiment of a prior art functional electronic and electrical block diagram of hearing aid 10 shown in FIGS. 1(*a*) and 2(*b*). In the block diagram of FIG. 2(*a*), and according to one embodiment, DSP 80 is a SOUND DESIGN TECHNOLOGIES® SA3286 INSPIRA EXTREME® DIGITAL DSP, for which data sheet 48550-2 dated March 2009, filed on even date herewith in an accompanying Information Disclosure Statement ("IDS"), is hereby incorporated by reference herein in its entirety. The audio processor for the SOPHONO ALPHA 1 hearing aid is centered around DSP chip 80, which provides programmable signal processing. The signal processing may be customized by computer software which communicates with the Alpha through programming port 125. According to one embodiment, the system is powered by a standard zinc air battery 95 (i.e. hearing aid battery), although other types of batteries may be employed. The SOPHONO ALPHA 1 hearing aid detects acoustic signals using a miniature microphone 85. A second microphone 90 may also be employed, as shown in FIG. 2(*a*). The SA 3286 chip supports directional audio processing with second microphone 90 to enable directional processing. Direct Audio Input (DAI) connector 150 allows connection of accessories which provide an audio signal in addition to or in lieu of the microphone signal. The most common usage of the DAI connector is FM systems. The FM receiver may be plugged into DAI connector 150. Such an FM transmitter can be worn, for example, by a teacher in a classroom to ensure the teacher is heard clearly by a student wearing hearing aid 10. Other DAI accessories include an adapter for a music player, a telecoil, or a Bluetooth phone accessory. According to one embodiment, DSP 80 or SA 3286 has 4 available program memories, allowing a hearing health professional to customize each of 4 programs for different listening situations. The Memory Select Pushbutton 145 allows the user to choose from the activated memories. This might include special frequency adjustments for noisy situations, or a program which is Directional, or a program which uses the DAI input.

FIG. 2(*b*) shows one embodiment of a prior art wiring diagram for a SOPHONO ALPHA 1 hearing aid manufactured using the foregoing SA3286 DSP. Note that the various embodiments of hearing aid 10 are not limited to the use of a SA3286 DSP, and that any other suitable CPU, processor, controller or computing device may be used. According to one embodiment, DSP 80 is mounted on a printed circuit board 155 disposed within housing 110 and/or housing 115 of hearing aid 10 (not shown in the Figures).

In some embodiments, the microphone incorporated into hearing aid 10 is an 8010T microphone manufactured by SONION®, for which data sheet 3800-3016007, Version 1 dated December, 2007, filed on even date herewith in the accompanying IDS, is hereby incorporated by reference herein in its entirety. Other suitable types of microphones, including other types of capacitive microphones, may be employed.

In still further embodiments, the electromagnetic transducer 25 incorporated into hearing aid 10 is a VKH3391W transducer manufactured by BMH-Tech® of Austria, for which the data sheet filed on even date herewith in the accompanying IDS is hereby incorporated by reference herein in its entirety. Other types of suitable EM or other types of transducers may also be used.

FIGS. 3(*a*), 3(*b*) and 3(*c*) show implantable bone plate or magnetic implant 20 in accordance with FIG. 1(*a*), where frame 22 has disposed thereon or therein magnetic members 60*a* and 60*b*, and where magnetic spacer 50 of hearing aid 10 has magnetic members 55*a* and 55*b* spacer disposed therein. The two magnets 60*a* and 60*b* of magnetic implant 20 of FIG. 2(*a*) permit hearing aid 10 and magnetic spacer 50 to be placed in a single position on patient's skull 70, with respective opposing north and south poles of magnetic members 55*a*, 60*a*, 55*b* and 60*b* appropriately aligned with respect to one another to permit a sufficient degree of magnetic coupling to be achieved between magnetic spacer 50 and magnetic implant 20 (see FIG. 3(*b*)). As shown in FIG. 1(*a*), magnetic implant 20 is preferably configured to be affixed to skull 70 under patient's skin 75. In one aspect, affixation of magnetic implant 20 to skull 75 is by direct means, such as by screws 15. Other means of attachment known to those skilled in the art are also contemplated, however, such as glue, epoxy, and sutures.

Referring now to FIG. 3(*b*), there is shown a SOPHONO® ALPHA 1® hearing aid 10 configured to operate in accordance with magnetic implant 20 of FIG. 3(*a*). As shown, hearing aid 10 of FIG. 3(*b*) comprises upper housing 111, lower housing 115, magnetic spacer 50, external magnets 55*a* and 55*b* disposed within spacer 50, EM transducer diaphragm 45, metal disk 40 connecting EM transducer 25 to spacer 50, programming port/socket 125, program switch 145, and microphone 85. Not shown in FIG. 3(*b*) are other aspects of the embodiment of hearing aid 10, such as volume control 120, battery compartment 130, battery door 135, battery contacts 140, direct audio input (DAI) 150, and hearing aid circuit board 155 upon which various components are mounted, such as DSP 80.

Continuing to refer to FIGS. 3(*a*) and 3(*b*), frame 22 of magnetic implant 20 holds a pair of magnets 60*a* and 60*b* that correspond to magnets 55*a* and 55*b* included in spacer 50 shown in FIG. 3(*b*). The south (S) pole and north (N) poles of magnets 55*a* and 55*b*, are respectively configured in spacer 50 such that the south pole of magnet 55*a* is intended to overlie and magnetically couple to the north pole of magnet 60*a*, and such that the north pole of magnet 55*b* is intended to overlie and magnetically couple to the south pole of magnet 60*b*. This arrangement and configuration of magnets 55*a*, 55*b*, 60*a* and 60*b* is intended permit the magnetic forces required to hold hearing aid 10 onto a patient's head to be spread out or dispersed over a relatively wide surface area of the patient's hair and/or skin 75, and thereby prevent irritation of soreness that might otherwise occur if such magnetic forces were spread out over a smaller or more narrow surface area. In the embodiment shown in FIG. 3(*a*), frame 22 and magnetic implant 20 are configured for affixation to patient's skull 70 by means of screws 15, which are placed through screw recesses or holes 23. FIG. 3(*c*) shows an embodiment of hearing aid 10 configured to operate in conjunction with a single magnet 60 disposed in magnetic implant 20 per FIG. 1(*a*).

Referring now to FIGS. 4, 5, and 7-11 there are shown various embodiments of a sound transmission device 100 that is configured to operate in conjunction with magnetic implant 20 and magnetic hearing aid 10. As shown in such Figures, implantable and biocompatible sound transmission device 100 is configured for implantation in a patient's skull and comprises proximal end 110 and distal end 120. Proximal end 110 is configured for placement near or at an interface disposed between the patient's skin and skull bone located therebeneath. Distal end 120 is configured for placement near or at a cochlea of the patient. Proximal end 110 of sound transmission device 100 is configured to receive acoustic signals generated by EM transducer 25 disposed in hearing aid 10 that are transmitted through the patient's skin 75. Sound transmission device 100 is further configured to transmit the received acoustic signals from proximal end 110 to distal end 120 thereof.

Figure 10:
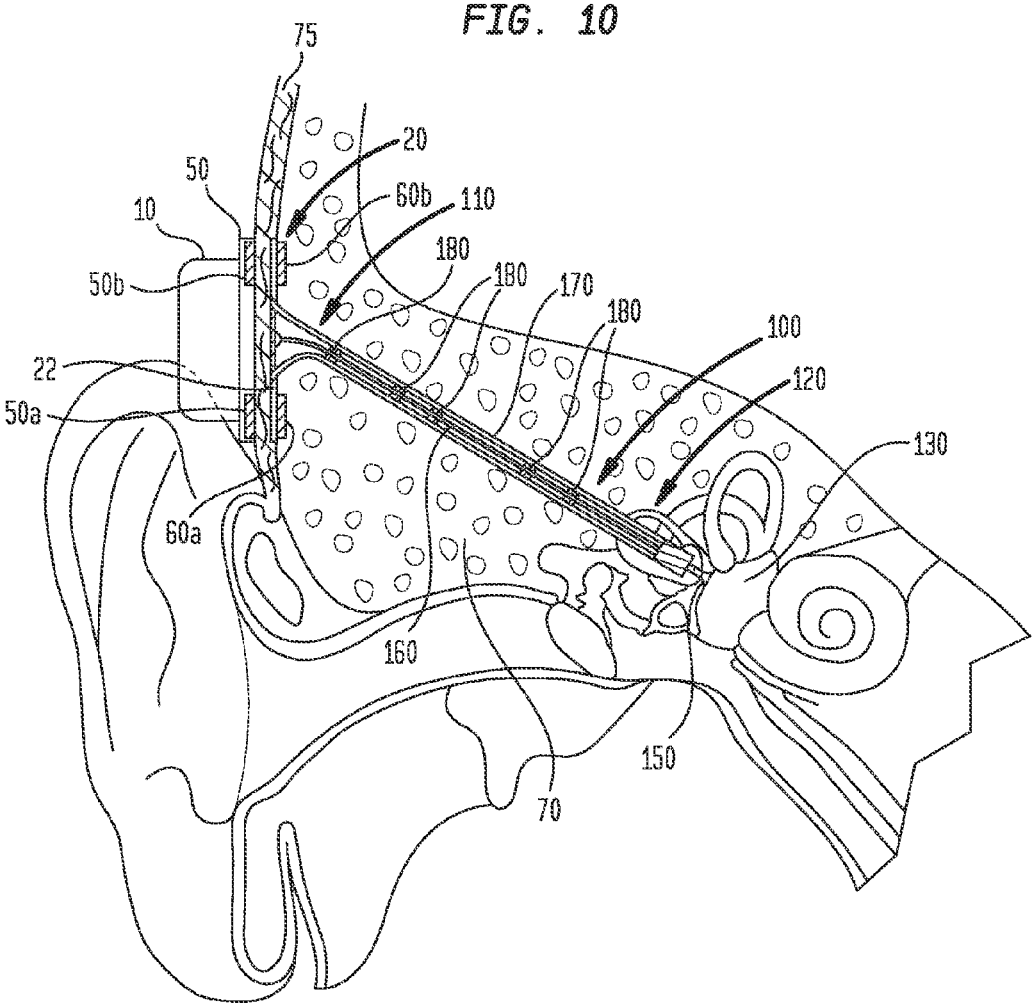
FIG. 10 shows a cross-sectional view of yet another embodiment of sound transmission device 100 implanted within the skull of a patient and a corresponding overlying magnetic implant 20, in conjunction with one embodiment of external hearing aid 10.
Figure 11:
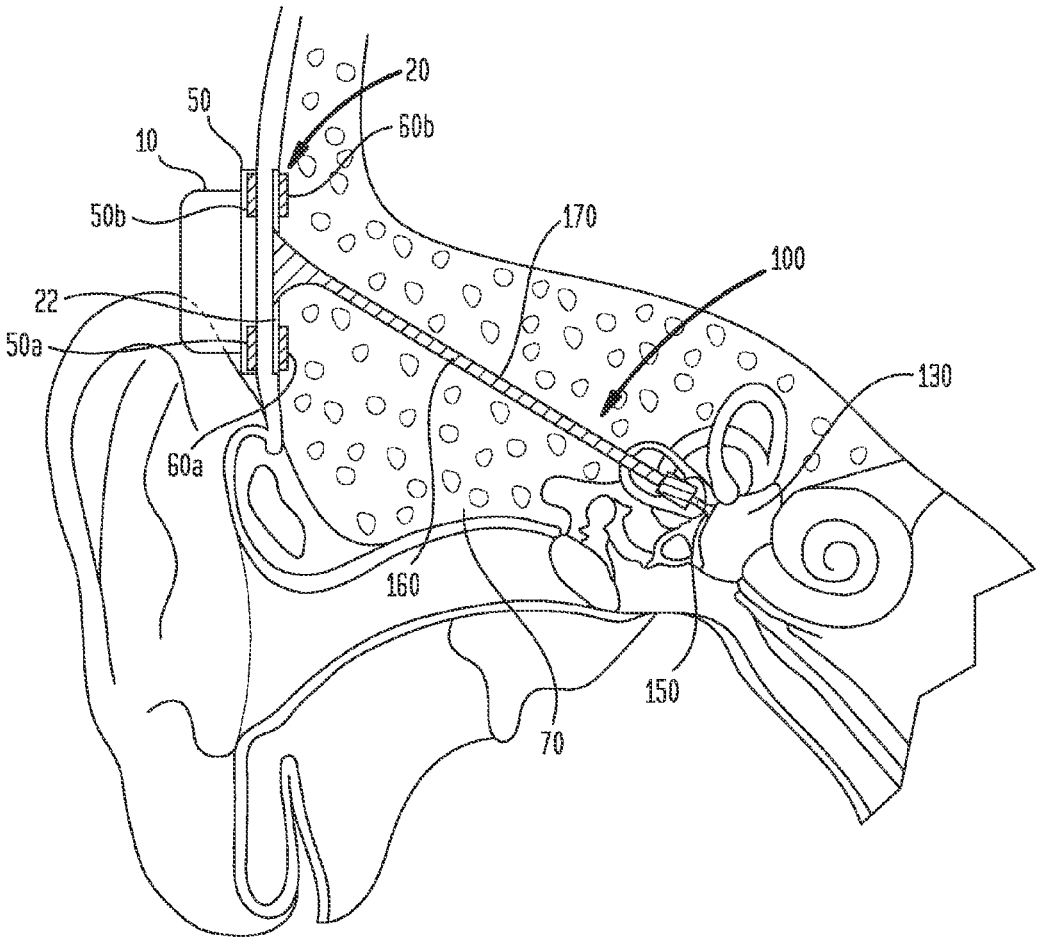
FIG. 11 shows a cross-sectional view of still another embodiment of sound transmission device 100 implanted within the skull of a patient and a corresponding overlying magnetic implant 20, in conjunction with one embodiment of external hearing aid 10.

In some embodiments of sound transmission device 100, sound transmission device 100 comprises at least a first sound-transmitting metal members 105, which may assume the form of one or more internal first sound-transmitting metal member (e.g., see FIGS. 4 through 10), or which may assume the form of a solid or substantially solid metal rod, cylinder or member 105 that defines the external geometry of sound transmission device 100 (e.g., see FIG. 11). The at least first sound-transmitting metal member 105 may further be a rod, a metal wire, or a plurality of twisted or stranded metal wires.

In further embodiments, magnetic implant 20 is disposed in metal frame 22, and at least portions of frame 22 or an attachment thereto extend from frame 22 to a location near proximal end 120 of sound transmission device 100, thereby to efficiently transmit acoustic signals originating from transducer 25 through magnetic implant 20 to sound transmission device 100. In these and other embodiments, proximal end 110 of sound transmission device 100 may be configured for placement near or at magnetic implant 20 or frame 22 associated therewith.

As further shown in FIGS. 4, 5, and 7-11, and in some embodiments, distal end 120 of sound transmission device 100 has artificial stapes 150 attached thereto.

In the embodiments of sound transmission device 100 shown in FIGS. 4 through 10, sound transmission device 100 comprises at least one inner chamber 160 configured to have disposed therewithin at least portions of the at least one sound-transmitting metal member 105. The at least one inner chamber 160 is defined at least partially by outer sidewalls 170 of sound transmission device 100, the outer sidewalls not being in direct contact with the at least one sound-transmitting metal member 105. According to some embodiments, the at least one sound-transmitting metal member 105 may be spaced apart from outer sidewalls 170 by at least one of spacer 180, or a sealant, compound, adhesive, foam, and/or and a fluid, wherein spacer 180, or the sealant, compound, adhesive, foam, or fluid is at least partially mechanically deformable, elastic or resilient, thereby to permit efficient transmission of sound through sound-transmitting metal member 105 between the proximal and distal ends of sound transmission device 100.

As shown in the embodiments illustrated in FIGS. 4, 5, and 7-11, proximal end 110 of sound transmission device 100 may further comprise a sound reception diaphragm or membrane 190 operably connected to sound-transmitting metal member 105 by means of mechanical connection 192, which may be solder, an adhesive, a weld, or any other suitable connection. In some embodiments, by way of non-limiting example, diaphragm or membrane 190 ranges between about 5 mm and about 10 mm in diameter. In the embodiment shown in FIG. 11, sound transmission device 100 forms a solid or substantially solid device having no interior chambers 160 disposed therewithin, and where the body of sound transmission device 100 accomplishes the functionality of sound transmitting members 105 characteristic of the embodiments shown in FIGS. 4, 5, and 7-10.

In some embodiments, sound transmission device 100 further comprises a protective cover positioned over diaphragm or membrane 190 that is configured to prevent tissue growth thereover, and thus prevent such tissue growth from affecting or inhibiting the operation or resonance of diaphragm or membrane 190.

Figure 4:
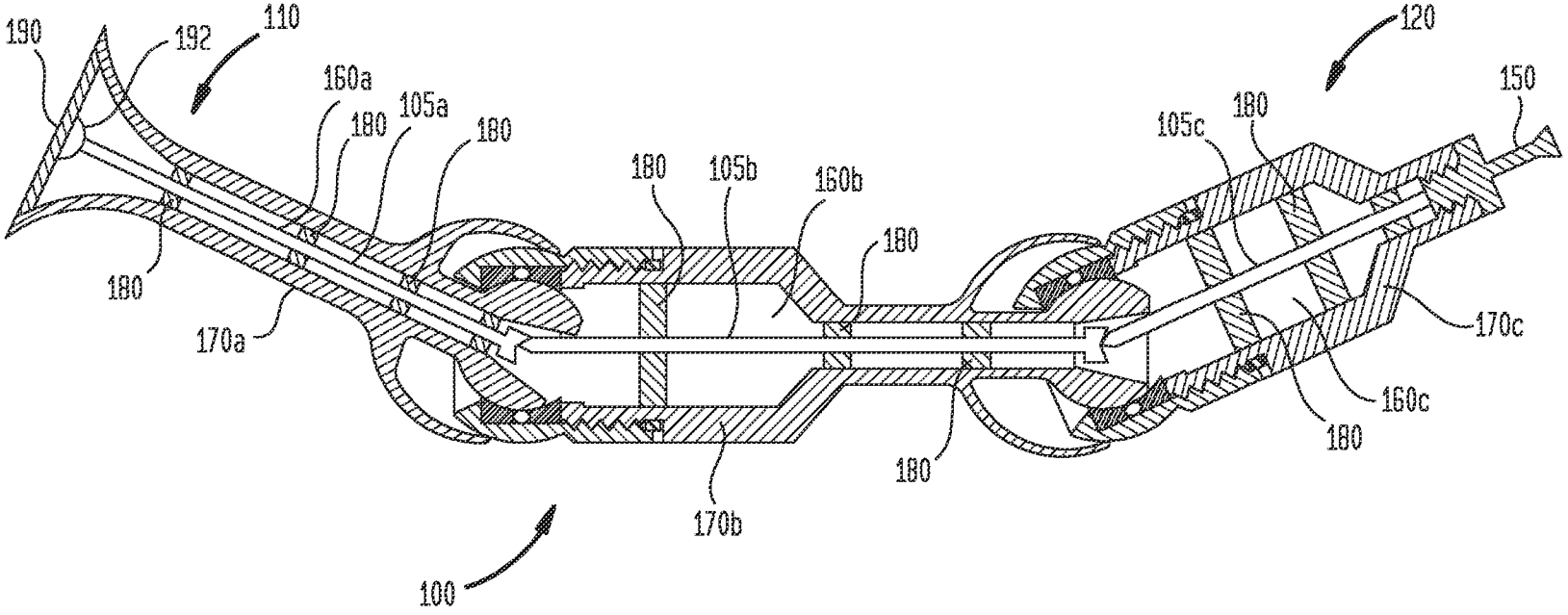
FIG. 4 shows a cross-sectional view of one embodiment of a sound transmission device 100.
Figure 5:
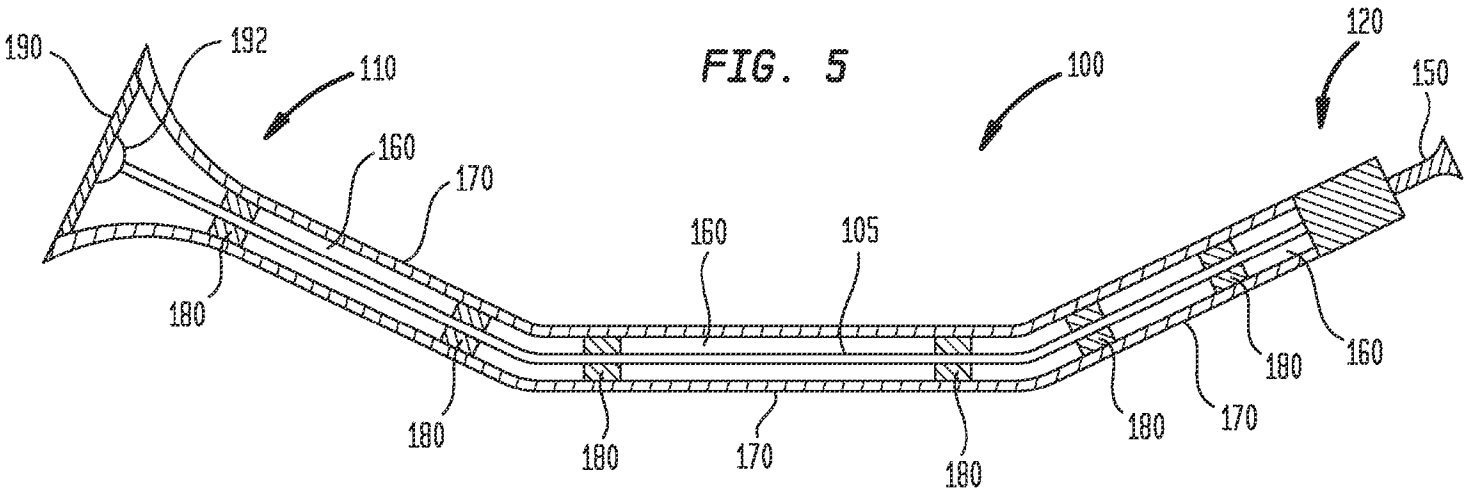
FIG. 5 shows a cross-sectional view of another embodiment of a sound transmission device 100.
Figure 7:
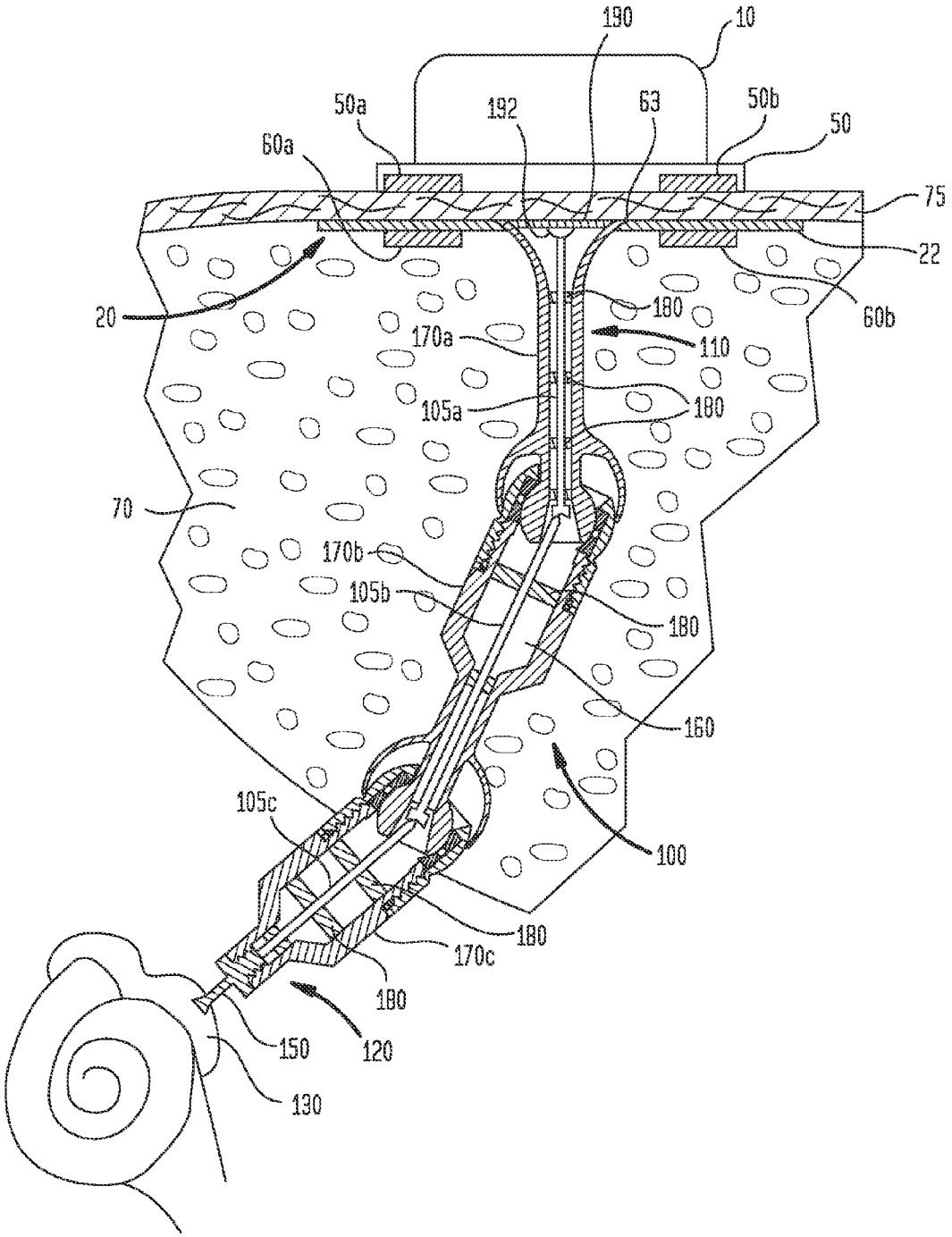
FIG. 7 shows a cross-sectional view of the embodiment of sound transmission device 100 shown in FIG. 5 implanted within the skull of a patient and a corresponding overlying magnetic implant 20, in conjunction with one embodiment of external hearing aid 10, in conjunction with one embodiment of external hearing aid 10.

FIGS. 4 and 7 show embodiments of sound transmission device 100 that comprise a plurality of sound-transmitting metal members 105*a*, 105*b* and 105*c* that are operably connected to one another, and that permit sound transmission device 100 to assume a desired curved or non-linear shape. Such shapes can be employed to optimally and comfortably position magnetic hearing aid 10 and magnetic implant 10 behind the patient's ear, while still providing a suitable pathway or passageway for sound transmission device 100 through the patient's skull and bone to a location near or on the patient's cochlea 130. The thickness of bone in a patient's skull varies substantially over relatively short distances in the region behind beneath a patient's ear. According to some embodiments, the curved or non-linear shape of sound transmission device 100 permits sound transmission device 100 to be implanted wholly within bone except for where distal end 120 emerges from the bone for placement near or on the patient's cochlea 130, while permitting magnetic hearing aid 10 and magnetic implant 20 to be positioned a comfortable and suitable distance away from and behind the patient's ear.

Figure 6:
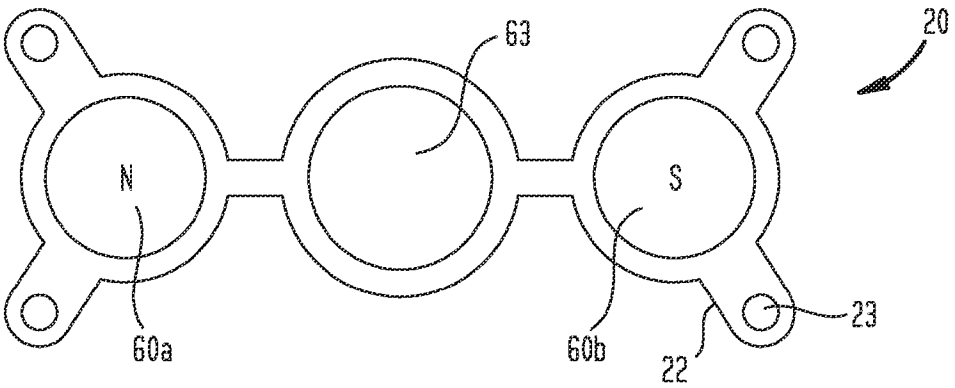
FIG. 6 shows a top view of one embodiment of a magnetic implant 20 that may be employed in conjunction with a sound transmission device 100.

In some embodiments, proximal end 110 of sound transmission device 100 is operably connected to frame 22 forming a portion of magnetic implant 20. FIG. 6 shows one embodiment of frame 22 of magnetic implant 20 having a central aperture 63 shaped and configured for attachment to proximal end 110 of sound transmission device 100. As shown in FIGS. 7 through 11, sound transmission device 100 may be operably attached to or coupled with frame 22 of magnetic implant 20. In other embodiments, sound transmission device 100 is not attached to or coupled with frame 22 of magnetic implant 20, and instead proximal end 110 of device 100 is placed in sufficiently close proximity to magnetic implant 20 and frame 22 such that acoustic signals generated by hearing aid 10 are received with sufficient amplitude and fidelity by device 100 to permit the patient to hear such signals with adequate amplitude and fidelity. If connected to frame 22, and in one embodiment, proximal end 110 of sound transmission device 100 may also be separated from frame 22 by an intervening acoustic isolation member, such as a polymeric or other sound deadening or isolating ring or gasket or other configuration of such material.

According to some embodiments, sound-transmitting metal member(s) 105 may comprise comprises one or more of a metal, a metal alloy, stainless steel, titanium, or a combination or mixture thereof.

As shown in FIGS. 10 and 11, and in further embodiments, substantial portions of sound transmission device 100 are substantially straight between patient's skin 75 and cochlea 130. Such straight or linear configurations of sound transmission device 100 simplify implantation of sound transmission device 100 in a patient's skull because the passageway that must be surgically formed in bone to accept sound transmission device therein is straight, and not curved. The particular methods and procedures employed to form substantially straight passageways in bone are well known in the art, and are therefore not discussed further herein.

Figure 8:
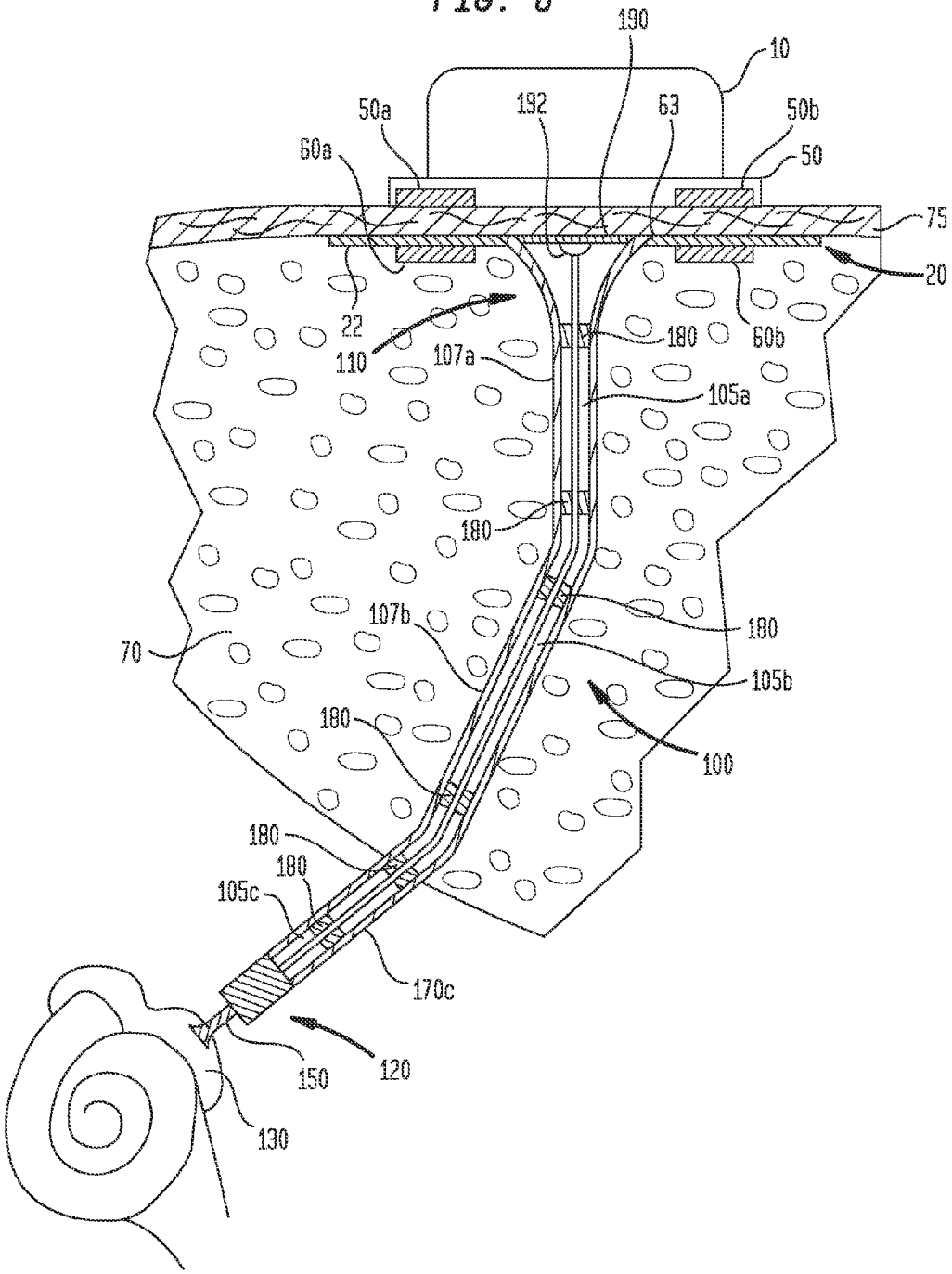
FIG. 8 shows a cross-sectional view of the embodiment of sound transmission device 100 shown in FIG. 5 implanted within the skull of a patient and a corresponding overlying magnetic implant 20, in conjunction with one embodiment of external hearing aid 10.
Figure 9:
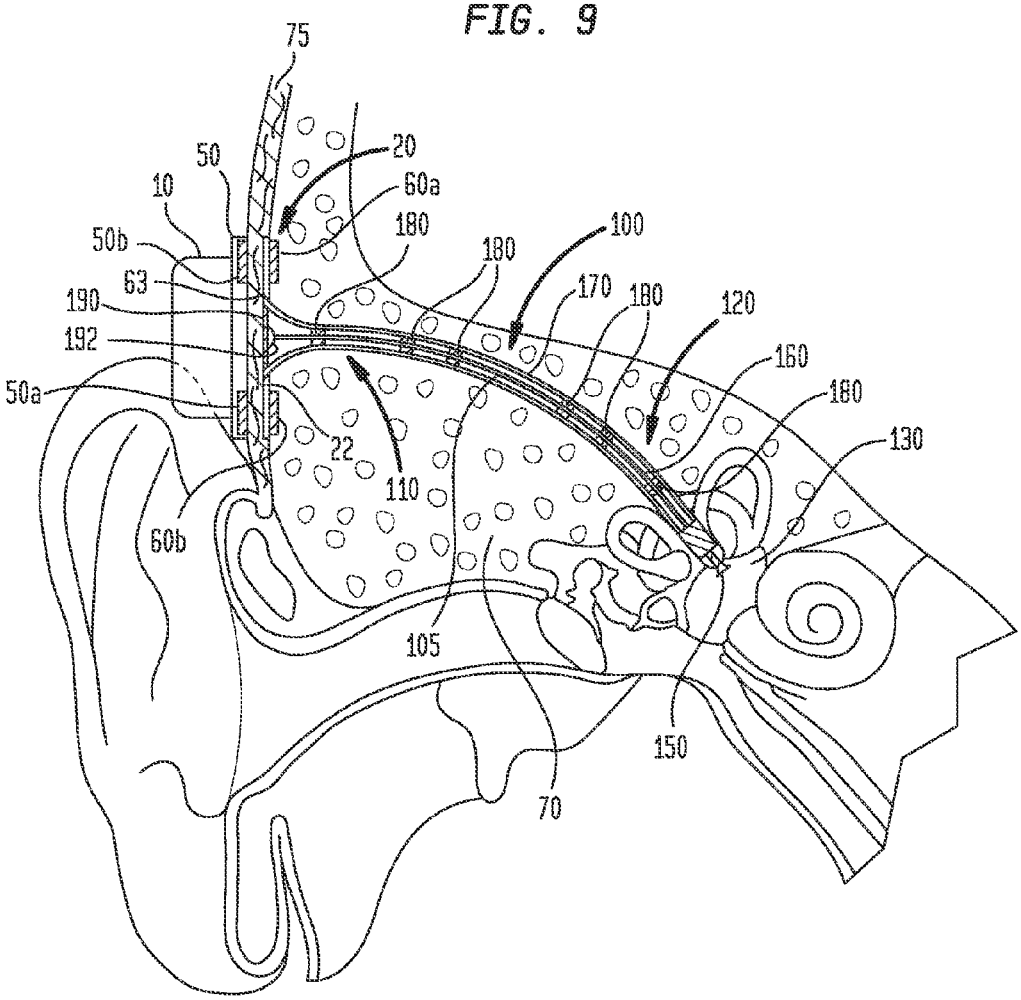
FIG. 9 shows a cross-sectional view of another embodiment of sound transmission device 100 implanted within the skull of a patient and a corresponding overlying magnetic implant 20, in conjunction with one embodiment of external hearing aid 10.

As shown in FIGS. 7, 8 and 9, and in still further embodiments, portions of sound transmission device 100 are curved along their lengths such that substantial portions of sound transmission device 100 are located entirely within bone, excepting distal end 120 and stapes 150, which are positioned near the patient's cochlea 130. As discussed above, such curved geometries of sound transmission device 100 permit optimal and comfortable placement of hearing aid 10 and magnetic implant 20 behind the patient's ear. The particular methods and procedures employed to form curved passageways in bone are well known in the art, and are therefore not discussed further herein.

Referring now to FIGS. 4, 5 and 7 through 11, and according to some embodiments, the overall length between proximal end 120 and distal end 110 of sound transmission device 100 may range, by way of non-limiting example, between about 40 mm and about 70 mm, where the length of device 100 is selected on the basis of the particular anatomy of the patient within whom device 100 is to be implanted. It is well known that the skull and bone anatomies, proportions and geometries of patients can vary according to age, sex, and other physiological factors, and therefore providing sound transmission devices of varying lengths can be desirable. Continuing to refer to such Figures, substantial portions of sound transmission device 100, apart from proximal end 110, may be configured to have diameters ranging between about 2 mm and about 6 mm. Other diameters, lesser and greater, such as about 1 mm and about 7 mm or 8 mm, are also contemplated. In addition, and in those embodiments where sound-transmitting members are disposed inside one or more chambers within sound transmission device 100 (e.g., see FIGS. 4, 5, 7, 8, 9 and 10), substantial portions of sound-transmitting members 105 may have, by way of non-limiting example, a diameter ranging between about 0.5 mm and about 2 mm. Other diameters, by way of non-limiting example, lesser and greater, such as about 0.4 mm and about 3 mm, are also contemplated.

As shown in FIGS. 4 and 6, and in some embodiments, sound transmitting device 100 comprises a plurality of sections, such as sections formed by 170*a*/105*a*, 170*b*/105*b*, and 170*c*/105*c*, that are operably and at least partially rotatably connected to one another by means of spherical ball-and-joint connections, thereby to provide the ability to form a custom curved geometry for device 100 according to the anatomical requirements of the particular patient at hand. In other embodiments, and as further shown in FIGS. 5, 8 and 9, sound transmitting device 100 comprises a plurality of sections, such as sections formed by 170*a*/105*a*, 170*b*/105*b*, and 170*c*/105*c*, that are operably rigidly connected to one another by means of solid connections, and which can be configured to provide a predetermined curved geometry for device 100, the particular dimensions of which may be selected according to the anatomical requirements of the particular patient at hand.

With reference to the embodiments of sound transmission device 100 shown in FIGS. 4 and 7, and modifications, variants or permutations thereof that those skilled in the art will appreciate after having read and understood the present specification, at least some of the plurality of sections may be tightened, loosened, shortened and/or lengthened by a physician or other health care provider prior to or during an implantation procedure to: (a) customize the lengths of such sections according to a particular patient's anatomy; (b) form desired angles between adjoining sections according to a particular patient's anatomy; (c) place sound-transmitting members 105 under further or less compression, or (d) place sound-transmitting members 105 under further or less tension.

Sound transmission device 100 may also be formed of or include shape memory materials, such as shape memory polymers, plastics, thermoplastics, metals, and/or metal alloys or combinations to further facilitate the provision of a desirable geometry for implantation in a patient. In embodiments of sound transmission device 100 containing one or more internal chambers or recesses 160, it may be desirable to hermetically seal sound transmission device 100 to prevent the ingress of body fluids or tissues therein. As a medically implantable device, sound transmission device 100 most preferably comprises suitable biocompatible materials, such as stainless steel or titanium. Various biocompatible polymeric and other coatings may also be applied to the exterior surfaces of sound transmission device 100. Various types of adhesives may also be employed to secure or aid in securing diaphragm or membrane 190 or other components to sound transmission device 100, such as biocompatible epoxies, curable epoxies, silicone and other medical grade adhesives known in the art.

In further embodiments, sound transmission device 100 may comprise means for securing or attaching device 100 to skin 75, bone 50 and/or magnetic implant 20 such as screws, tangs, or wings. Such securing means may also be configured to permit the in-growth of tissue therethrough (or not), or to permit replacement of such securing or attachment means at a later date with securing means of different dimensions or other characteristics. Moreover, sound transmission device 100 may be attached or secured to skin 75, bone 50 and/or magnetic implant 20 by any of a number of different means, such as medical grade adhesives, detents, tangs, protrusions, tabs, channels and corresponding mateable protrusions or other mechanical features or elements, tape, or other mechanical components or devices.

Figure 12:
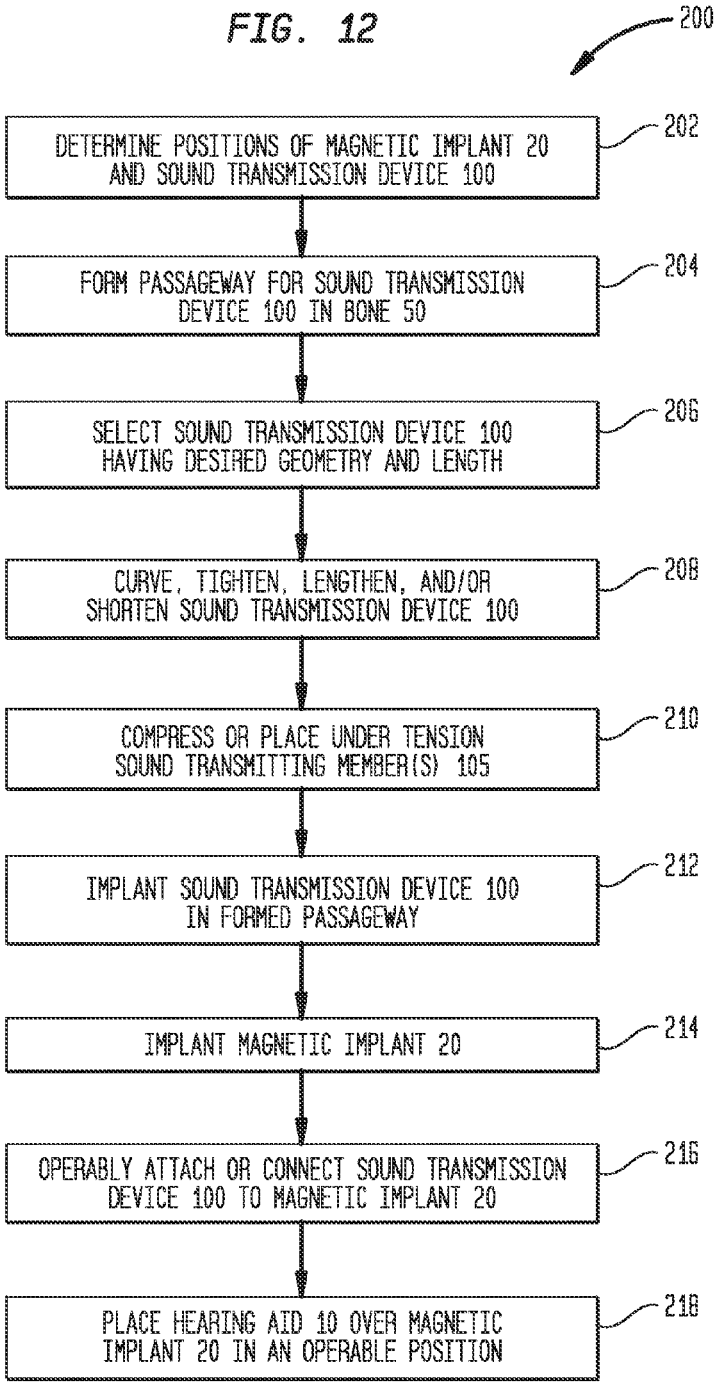
FIG. 12 shows one method of implanting sound device 100 and magnetic implant 20 in a patient.

Turning now to FIG. 12, there is illustrated one embodiment of a method 200 for implanting sound transmission device 100 in a patient. At step 202, optimal positions of magnetic implant 20 and sound transmission device 100 in the temporal region of a patient's skull 70 are determined behind the patient's ear. At step 204, a passageway is formed in the patient's skull between a proximal location behind the patient's ear and a distal location near patient's cochlea 130. In one embodiment, step 204 includes drilling through portions of the patient's skull. At step 206, and according to some embodiments of sound transmission device 100, a sound transmission device 100 having an optimum or desirable length or geometry that is configured for a patient's particular anatomy is selected. At step 208, and according to some embodiments of sound transmission device 100, sound transmission device 100 is curved, shortened or lengthened prior to implantation by a physician or health care provider. At step 210, and according to some embodiments of sound transmission device 100, one or more sound-transmitting members 105 of sound transmission device 100 are compressed or placed under tension prior to implantation by a physician or health care provider. At step 212, sound transmission device 100 is implanted in the passageway with distal end 120 thereof acoustically and operably connected to or near the patient's cochlea. At step 214, magnetic implant 20 is implanted beneath patient's skin 75, on or in the patient's skull or bone 50, and in an operable position with respect to the now-implanted or yet-to-be-implanted sound transmission device 100. At step 216, and according to some embodiments of sound device 100 and magnetic implant 20, sound transmission device 100 is operably connected or attached to magnetic implant 20. In step 216, and according to some embodiments of sound device 100 and magnetic implant 20, sound transmission device 100 is implanted and positioned with respect to magnetic implant 20 and frame 22 corresponding thereto such that at least portions of frame 22 or an attachment thereto extend from frame 22 to a location near proximal end 110 of sound transmission device 100. At step 218, magnetic spacer 50 and EM transducer 25 of hearing aid 10 are placed in an operable position over magnetic implant 20, and on top of the patient's skin 75. One or more of steps 202 through 218 may be carried out in an order different from that shown in FIG. 12. In method 200, some steps of FIG. 12 may not be carried out, and other steps not specified explicitly herein may be added, as those skilled in the art will understand and appreciate.

Those skilled in the art will now understand that many different permutations, combinations and variations of sound transmission device 100 and magnetic implant 20 fall within the scope of the various embodiments. For example, sound transmission device may be solid or have chambers disposed therein. Sound transmission device 100 may be configured for attachment to magnetic implant 20, or for placement nearby. Sound transmission device 100 may be substantially straight, or may be curved along one or more planes or radii of curvature, or may be curved in two or three dimensions. Sound transmission device 100 may have a bell- or horn-shaped proximal end 110, or may be configured to have straight or linearly-shaped proximal end 110, such as in configurations where proximal end 110 of sound transmission 100 is operably attached or positioned with respect to an extension or attachment of frame 22. Sound transmission device 100 may be formed of or comprise any number of different materials, such as metals, metal alloys, metal combinations, polymers, plastics, which according to the manner in which they are employed and positioned in sound device 100 may be biocompatible. Sound transmission device 100 may also comprise one or more suitable liquids or semi-solids hermetically sealed and disposed therewithin that are formulated and provided for the purpose of transmitting sound from one end to the other thereof, or between portions thereof, which according to the manner in which they are employed and positioned in sound device 100 may be biocompatible. Such liquids and/or semi-solids, appropriately configured and formulated, may be employed to replace in whole or in part the functionality of the metal sound transmitting members or sections described above. Surgical techniques other than those described or disclosed explicitly herein may be employed to implant magnetic implant 20 and sound transmission device 100. Those skilled in the art will now appreciate that many different combinations, permutations and configurations of magnetic implants and sound transmission devices may be employed to arrive at suitable configurations of same. Moreover, the above-described embodiments should be considered as examples, rather than as limiting the scopes thereof.

We claim:

1. A magnetic hearing aid system, comprising:

an electromagnetic ("EM") transducer disposed in a housing;

a magnetic spacer operably coupled to the EM transducer and comprising at least a first magnetic member, the EM transducer and magnetic spacer forming external portions of the magnetic hearing aid system;

a magnetic implant configured for placement beneath a patient's skin and adjacent to or in a patient's skull, the magnetic implant comprising at least a second magnetic member, the magnetic spacer and magnetic implant together being configured such that the first and second magnetic members are capable of holding the EM transducer and magnetic spacer in position on the patient's head over at least portions of the magnetic implant through the patient's skin, and an implantable biocompatible sound transmission device configured for implantation in a patient's skull and comprising proximal and distal ends, the proximal end being configured for placement near or at an interface disposed between the patient's skin and skull bone located therebeneath, the distal end being configured for placement near or at a cochlea of the patient, the sound transmission device comprising outer sidewalls, at least one inner chamber, and at least one sound-transmitting metal member, the at least one inner chamber being configured to have disposed therewithin at least portions of the at least one sound-transmitting metal member, the at least one sound-transmitting metal member being disposed within at least portions of the outer sidewalls and spaced apart therefrom by at least one of a spacer, a sealant, a compound, an adhesive, a fluid, and a foam;

wherein the sound transmission device is further configured: (a) to receive acoustic signals generated by the EM transducer and transmitted through the patient's skin; (b) to mechanically transmit and propagate the received acoustic signals between the proximal and distal ends thereof through at least portions of the at least a one sound-transmitting metal member; (c) in an at least partially curved shape such that proximal and central portions of the sound transmission device may be implanted wholly within the patient's skull bone behind the patient's ear.

2. The magnetic hearing aid system of claim 1, wherein the at least one sound-transmitting metal member is a rod, a metal wire, or a plurality of twisted or stranded metal wires.

3. The magnetic hearing aid system of claim 1, wherein the at least one sound transmitting metal member is solid.

4. The magnetic hearing aid system of claim 1, wherein the magnetic implant is disposed in a metal frame, and at least portions of the frame or an attachment thereto extend from the frame to a location near the proximal end of the sound transmission device.

5. The magnetic hearing aid system of claim 1, wherein the proximal end of the sound transmission device is configured for placement near or at the magnetic implant or a frame associated therewith.

6. The magnetic hearing aid system of claim 1, wherein the distal end of the sound transmission device has an artificial stapes attached thereto.

7. The magnetic hearing aid system of claim 1, wherein the inner chamber is defined at least partially by the outer sidewalls.

8. The magnetic hearing aid system of claim 1, wherein the spacer, sealant, compound, adhesive, foam, or fluid is at least partially mechanically deformable, elastic or resilient.

9. The magnetic hearing aid system of claim 1, wherein the proximal end of the sound transmission device further comprises a sound reception diaphragm or membrane operably connected to the sound-transmitting metal member.

10. The magnetic hearing aid system of claim 9, wherein a protective cover is positioned over the diaphragm or membrane to prevent tissue growth thereover.

11. The magnetic hearing aid system of claim 10, wherein the diaphragm or membrane ranges between 5 mm and 10 mm in diameter.

12. The magnetic hearing aid system of claim 1, wherein the sound transmission device comprises a plurality of sound-transmitting metal members operably connected to one another.

13. The magnetic hearing aid system of claim 1, wherein the proximal end of the sound transmission device is operably connected to a frame forming a portion of the magnetic implant.

14. The magnetic hearing aid system of claim 12, wherein the proximal end of the sound transmission device is separated from the frame by an acoustic isolation member.

15. The magnetic hearing aid system of claim 1, wherein the sound-transmitting metal member comprises one or more of a metal, a metal alloy, stainless steel, or titanium, or a combination or mixture thereof.

16. The magnetic hearing aid system of claim 1, wherein portions of the sound transmission device are straight when disposed between the patient's skin and the cochlea.

17. The magnetic hearing aid system of claim 1, wherein a length between proximal and distal ends of the sound transmission ranges between 40 mm and 70 mm.

18. The magnetic hearing aid system of claim 1, wherein at least portions of the sound transmission device have a diameter ranging between 2 mm and 6 mm.

19. The magnetic hearing aid system of claim 1, wherein at least portions of the at least one sound-transmitting member have a diameter ranging between 0.5 mm and 2 mm.

20. The magnetic hearing aid system of claim 1, wherein the sound transmitting device comprises a plurality of sections operably and at least partially rotatably connected to one another.

21. The magnetic hearing aid system of claim 20, wherein at least some of the plurality of sections are configured to be shortened by a health care provider prior to or during an implantation procedure to customize the lengths of such sections according to the patient's anatomy or to place the at least one sound-transmitting member under compression.

22. The magnetic hearing aid system of claim 20, wherein at least some of the plurality of sections are configured to be extended by a health care provider prior to or during an implantation procedure to customize the lengths of such sections according to the patient's anatomy or to place the at least one sound-transmitting member under tension.

23. An implantable biocompatible sound transmission device for use in a magnetic hearing aid system, the system comprising an electromagnetic ("EM") transducer disposed in a housing, a magnetic spacer operably coupled to the EM transducer and comprising at least a first magnetic member, the EM transducer and magnetic spacer forming external portions of the magnetic hearing aid system, and a magnetic implant configured for placement beneath a patient's skin and adjacent to or in a patient's skull, the magnetic implant comprising at least a second magnetic member, the magnetic spacer and magnetic implant together being configured such that the first and second magnetic members are capable of holding the EM transducer and magnetic spacer in position on the patient's head over at least portions of the magnetic implant through the patient's skin, the sound transmission device comprising proximal and distal ends, the proximal end being configured for placement near or at an interface disposed between the patient's skin and skull bone located therebeneath, the distal end being configured for placement near or at a cochlea of the patient, the sound transmission device comprising outer sidewalls, at least one inner chamber, and at least one sound-transmitting metal member, the at least one inner chamber being configured to have disposed therewithin at least portions of the at least one sound-transmitting metal member, the at least one sound-transmitting metal member being disposed within at least portions of the outer sidewalls and spaced apart therefrom by at least one of a spacer, a sealant, a compound, an adhesive, a fluid, and a foam, the sound transmission device further being configured: (a) to receive acoustic signals generated by the EM transducer and transmitted through the patient's skin; (b) to mechanically transmit and propagate the received acoustic signals between the proximal and distal ends thereof through at least portions of the at least one sound-transmitting metal member, and (c) in an at least partially curved shape such that proximal and central portions of the sound transmission device may be implanted wholly within the patient's skull bone behind the patient's ear.

24. The implantable biocompatible sound transmission device of claim 23, wherein the at least one first sound-transmitting metal member is a rod, a metal wire, or a plurality of twisted or stranded metal wires.

25. The implantable biocompatible sound transmission device of claim 23, wherein the at least one sound transmitting metal member is solid.

26. The implantable biocompatible sound transmission device of claim 23, wherein the magnetic implant is disposed in a metal frame, and at least portions of the frame or an attachment thereto extend from the frame to a location near the proximal end of the sound transmission device.

27. The implantable biocompatible sound transmission device of claim 23, wherein the proximal end of the sound transmission device is configured for placement near or at the magnetic implant or a frame associated therewith.

28. The implantable biocompatible sound transmission device of claim 23, wherein the distal end of the sound transmission device has an artificial stapes attached thereto.

29. The implantable biocompatible sound transmission device of claim 23, wherein the inner chamber is defined at least partially by the outer sidewalls.

30. The implantable biocompatible sound transmission device of claim 23, wherein the spacer, sealant, compound, adhesive, foam, or fluid is at least partially mechanically deformable, elastic or resilient.

31. The implantable biocompatible sound transmission device of claim 23, wherein the proximal end of the sound transmission device further comprises a sound reception diaphragm or membrane operably connected to the sound-transmitting metal member.

32. The implantable biocompatible sound transmission device of claim 31, wherein a protective cover is positioned over the diaphragm or membrane to prevent tissue growth thereover.

33. The implantable biocompatible sound transmission device of claim 32, wherein the diaphragm or membrane ranges between 5 mm and 10 mm in diameter.

34. The implantable biocompatible sound transmission device of claim 23, wherein the sound transmission device comprises a plurality of sound-transmitting metal members operably connected to one another.

35. The implantable biocompatible sound transmission device of claim 23, wherein the proximal end of the sound transmission device is operably connected to a frame forming a portion of the magnetic implant.

36. The implantable biocompatible sound transmission device of claim 35, wherein the proximal end of the sound transmission device is separated from the frame by an acoustic isolation member.

37. The implantable biocompatible sound transmission device of claim 23, wherein the sound-transmitting metal member comprises one or more of a metal, a metal alloy, stainless steel, or titanium, or a combination or mixture thereof.

38. The implantable biocompatible sound transmission device of claim 23, wherein at least portions of the sound transmission device are straight when disposed between the patient's skin and the cochlea.

39. The implantable biocompatible sound transmission device of claim 23, wherein a length between proximal and distal ends of the sound transmission ranges between 40 mm and 70 mm.

40. The implantable biocompatible sound transmission device of claim 23, wherein at least portions of the sound transmission device have a diameter ranging between 2 mm and 6 mm.

41. The implantable biocompatible sound transmission device of claim 23, wherein at least portions of the at least one sound-transmitting member have a diameter ranging between 0.5 mm and 2 mm.

42. The implantable biocompatible sound transmission device of claim 23, wherein the sound transmitting device comprises a plurality of sections operably and at least partially rotatably connected to one another.

43. The implantable biocompatible sound transmission device of claim 42, wherein at least some of the plurality of sections are configured to be shortened by a health care provider prior to or during an implantation procedure to customize the lengths of such sections according to the patient's anatomy or to place the at least one sound-transmitting member under compression.

44. The implantable biocompatible sound transmission device of claim 42, wherein at least some of the plurality of sections are configured to be extended by a health care provider prior to or during an implantation procedure to customize the lengths of such sections according to the patient's anatomy or to place the at least one sound-transmitting member under tension.

45. A method of implanting an implantable biocompatible sound transmission device for use in a magnetic hearing aid system, the system comprising an electromagnetic ("EM") transducer disposed in a housing, a magnetic spacer operably coupled to the EM transducer and comprising at least a first magnetic member, the EM transducer and magnetic spacer forming external portions of the magnetic hearing aid system, and a magnetic implant configured for placement beneath a patient's skin and adjacent to or in a patient's skull, the magnetic implant comprising at least a second magnetic member, the magnetic spacer and magnetic implant together being configured such that the first and second magnetic members are capable of holding the EM transducer and magnetic spacer in position on the patient's head over at least portions of the magnetic implant through the patient's skin, the sound transmission device comprising proximal and distal ends, the proximal end being configured for placement near or at an interface disposed between the patient's skin and skull bone located therebeneath, the distal end being configured for placement near or at a cochlea of the patient, the sound transmission device comprising outer sidewalls, at least one inner chamber, and at least one sound-transmitting metal member, the at least one inner chamber being configured to have disposed therewithin at least portions of the at least one sound-transmitting metal member, the at least one sound-transmitting metal member being disposed within at least portions of the outer sidewalls and spaced apart therefrom by at least one of a spacer, a sealant, a compound, an adhesive, a fluid, and a foam, the sound transmission device being configured: (a) to receive acoustic signals generated by the EM transducer and transmitted through the patient's skin; (b) to mechanically transmit and propagate the received acoustic signals between the proximal and distal ends thereof through at least portions of the at least one sound-transmitting metal member, and (c) in an at least partially curved shape such that proximal and central portions of the sound transmission device may be implanted wholly within the patient's skull bone behind the patient's ear, the method comprising:

forming a passageway in the patient's skull between a proximal location behind the patient's ear and a distal location near the patient's cochlea such that distal and central portions of the sound transmission device are implanted wholly within the patient's skull bone behind the patient's ear, and implanting the sound transmission device in the passageway with the distal end thereof acoustically and operably connected to the patient's cochlea.

46. The method of claim 45, wherein forming the passageway includes drilling through portions of the patient's skull.

47. The method of claim 45, further comprising implanting the magnetic implant beneath the patient's skin, on or in the patient's skull, and in an operable position with respect to the sound transmission device.

48. The method of claim 47, further comprising operably connecting the sound transmission device to the magnetic implant.

49. The method of claim 47, further comprising placing the magnetic spacer and EM transducer in an operable position over the magnetic implant on top of the patient's skin.

50. The method of claim 47, further comprising placing implanting and positioning the sound transmission device in an operable position with respect to the magnetic implant and a metal frame corresponding thereto, wherein at least portions of the frame or an attachment thereto extend from the frame to a location near the proximal end of the sound transmission device.

51. The method of claim 47, further comprising placing a protective cover over the proximal end of the sound transmission device to prevent tissue growth thereover.

52. The method of claim 45, further comprising selecting or configuring the sound transmission device to have an optimum or desirable length or geometry that is configured for the patient's particular anatomy.

53. The method of claim 45, further comprising curving, shortening or lengthening the sound transmission device prior to implantation.

54. The method of claim 45, further comprising compressing or extending one or more sound transmission members disposed inside the sound transmission device prior to implantation.

* * * * *